US009512512B2

(12) United States Patent
Bamberg et al.

(10) Patent No.: US 9,512,512 B2
(45) Date of Patent: Dec. 6, 2016

(54) COATING METHOD FOR FORMING CRACK-RESISTANT COATINGS HAVING GOOD ADHERENCE AND COMPONENT COATED IN THIS MANNER

(71) Applicant: MTU Aero Engines GmbH, Munich (DE)

(72) Inventors: Joachim Bamberg, Dachau (DE); Roland Hessert, Herrsching (DE); Manuel Hertter, Munich (DE)

(73) Assignee: MTU Aero Engines GmbH, Munich (DE)

( * ) Notice: Subject to any disclaimer, the term of this patent is extended or adjusted under 35 U.S.C. 154(b) by 804 days.

(21) Appl. No.: 13/659,764

(22) Filed: Oct. 24, 2012

(65) Prior Publication Data

US 2013/0230723 A1 Sep. 5, 2013

(30) Foreign Application Priority Data

Oct. 25, 2011 (DE) ..... 10 2011 085 143

(51) Int. Cl.

| | |
|---|---|
| ***C23C 4/02*** | (2006.01) |
| ***C23C 24/04*** | (2006.01) |
| ***F01D 5/28*** | (2006.01) |

(52) U.S. Cl.

CPC ..... *C23C 4/02* (2013.01); *C23C 24/04* (2013.01); *F01D 5/288* (2013.01); *F05D 2230/10* (2013.01); *F05D 2230/30* (2013.01); *F05D 2230/31* (2013.01); *F05D 2230/313* (2013.01); *F05D 2230/90* (2013.01); *F05D 2300/605* (2013.01); *Y10T 428/31* (2015.01)

(58) Field of Classification Search

CPC ..... C23C 4/02; C23C 4/04

See application file for complete search history.

(56) References Cited

U.S. PATENT DOCUMENTS

| | | | | |
|---|---|---|---|---|
| 6,073,830 | A * | 6/2000 | Hunt et al. | 228/203 |
| 2006/0240192 | A1 | 10/2006 | Raybould et al. | |
| 2006/0261046 | A1* | 11/2006 | Scotchmer | 219/120 |
| 2006/0269685 | A1* | 11/2006 | Raybould et al. | 427/446 |
| 2008/0107369 | A1* | 5/2008 | Fujita et al. | 384/463 |
| 2009/0098286 | A1* | 4/2009 | Lui | C23C 24/04 427/189 |

(Continued)

FOREIGN PATENT DOCUMENTS

| | | | |
|---|---|---|---|
| DE | 40 41 103 | A1 | 7/1992 |
| DE | 10 2009 018 685 | A1 | 10/2010 |

(Continued)

OTHER PUBLICATIONS

Clemco Industries Corp Application News, Jun. 7, 2010, https://web.archive.org/web/20100607001708/http://www.clemcoindustries.com/news_detail.php?id=25.*

(Continued)

*Primary Examiner* — Xiao Zhao

(74) *Attorney, Agent, or Firm* — Crowell & Moring LLP

(57) ABSTRACT

A method for coating a component, in particular a component of a gas turbine or of an aircraft engine, is disclosed. The coating is applied to the component by kinetic cold gas spraying, where prior to the deposition of the coating, the surface of the component to be coated is cleaned and compacted by shot peening with a blasting media. A component produced in this manner is also disclosed.

10 Claims, 4 Drawing Sheets

(56) References Cited

U.S. PATENT DOCUMENTS

| | | | | |
|---|---|---|---|---|
| 2010/0320662 | A1* | 12/2010 | Tange et al. | 267/286 |
| 2012/0034092 | A1 | 2/2012 | Jakimov et al. | |

FOREIGN PATENT DOCUMENTS

| | | | |
|---|---|---|---|
| DE | 10 2009 030 683 | A1 | 1/2011 |
| WO | WO 2010/003396 | A1 | 1/2010 |

OTHER PUBLICATIONS

German-language Office Action issued in German counterpart application No. 10 2011 085 143.7 dated Mar. 1, 2016 (Five (5) pages).

Norm DIN EN 657 2005-06-00. Thermisches Spritzen—Begriffe, Einteilung; Deutsche Fassung EN 657:2005. [Perinorm], Jun. 2005, 23 pages. English translation: "Thermal spraying—Terminology, classification; German version EN 657:2005".

* cited by examiner

COATING METHOD FOR FORMING CRACK-RESISTANT COATINGS HAVING GOOD ADHERENCE AND COMPONENT COATED IN THIS MANNER

This application claims the priority of German Patent Document No. DE 10 2011 085 143.7, filed Oct. 25, 2011, the disclosure of which is expressly incorporated by reference herein.

BACKGROUND AND SUMMARY OF THE INVENTION

The present invention relates to a method for coating a component, in particular a component of a gas turbine or an aircraft engine, in which the coatings are applied to the component by kinetic cold gas spraying ["K3 coating" in German]. The present invention also relates to a component coated in this manner.

In many fields of technology it is necessary to provide coatings on components in order to protect the component from the effects of the environment. In particular, in environments with high temperatures or aggressive media, such as gas turbines or aircraft engines, components must be protected with wear-resistant layers, armoring, oxidation protection layers and the like. However, diverse tasks and aspects arise in the production of coatings, because many factors must be taken into account which have a mutual impact on one another. Therefore, the coating method must be suitable for the component or the material from which the component is formed and the material bond must interact in a reliable manner with the operating conditions.

Two aspects requiring great attention in the case of coatings for components of aircraft engines or gas turbines are related to the adhesive strength of the coating on the component and preventing crack propagation from the coating into the component. If adhesion is lacking, the coating may flake off reducing the service life of the component, and if there is crack propagation from the coating into the component, the strength of the component and thus the safety of the aircraft engine or the gas turbine is endangered. Consequently, these aspects require special attention and continuous improvement.

One method that is used to coat components of gas turbines or aircraft engines is the so-called cold gas spraying or kinetic cold gas spraying, also called the "K3 method" in German (or kinetic cold gas compaction). With this method, the coating material is accelerated at a high speed onto the component to be coated in the form of particles so that it can be deposited there. It is called cold gas spraying, because the material to be deposited is not heated to a melting temperature, as is the case with thermal spraying or flame spraying, but is used at lower temperatures. A method and a device for cold gas spraying are described in WO 2010/003396 A1 for example.

German Patent Document No. DE 10 2009 018 685 A1 relates to a method for producing an armoring of a blade tip as well as blades and gas turbines produced in this manner, wherein the armoring may likewise be applied by kinetic cold gas spraying. To prevent crack propagation from the armoring into the coated component, DE 10 2009 018 685 A1 proposes providing a porous layer beneath the armoring in order to stop crack propagation at the pores and thereby prevent crack propagation in the base material. Even though a solution to prevent crack propagation from coatings that are produced by cold gas spraying already exists, there continues to be a need for achieving improvement in the case of coatings that are produced by kinetic cold gas spraying, particularly with respect to improving adhesion strength and preventing crack propagation from the coating into the component.

Therefore, it is the object of the present invention to make available a method for coating a component, in particular a component of a gas turbine or an aircraft engine, in which the adhesion of the coating, which is applied by kinetic cold gas spraying is improved and a possible crack propagation from the coating into the component is prevented or at least slowed down. At the same time, it should be possible to execute the coating method in a simple and reliable manner.

The present invention is characterized in that, in the case of coatings that are produced by kinetic cold gas spraying, an improvement in the adhesion strength and a reduction in crack propagation or crack growth from the coating into the component are able to be achieved if a pretreatment of the surface of the component to be coated is carried out in which the surface of the to-be-coated component is cleaned and compacted by blasting media striking the surface. The pretreatment is correspondingly designated as shot peening and the component surface is strengthened thereby. At the same time, a cleaning is carried out, because any adhering dirt and/or thin oxide layers, which form on metallic components in particular, are eliminated.

According to one embodiment, shot peening may be carried out in particular in two or more stages, wherein during the different stages the blasting velocity of the blasting media is varied. A corresponding change in the blasting velocity may also be carried out continuously.

The change in the blasting velocity may be carried out with increasing treatment duration in such a manner that the blasting velocity of the blasting media is increased, i.e., the blasting velocity during the first stage is lower than in the second stage or, in the case of a continuous change in the blasting velocity, is higher at the end of shot peening than at the beginning of shot peening.

Because shot peening is merely supposed to cause a compaction of the surface and/or cleaning of the surface, and embedding of the blasting media used for shot peening is not supposed to occur, increasing the blasting velocity of the blasting media with the treatment duration makes it possible to effectuate a high strengthening of the surface area of the component to be coated without the blasting media getting embedded in the surface.

During shot peening, the blasting velocity of the blasting media may always be kept low enough that no substantial adherence of the blasting media to the surface of the component to be coated occurs during the shot peening. In particular, the blasting velocity of the blasting media may be kept below the speed of sound at the beginning of shot peening, while the blasting velocity may be set above the speed of sound at the end of shot peening.

The strengthened layer formed by the shot peening prevents cracks which have formed in the coating from being able to easily propagate into the component, and for them to be stopped at the interface to the component. The treatment of the surface with the blasting media also causes troublesome oxide layers to be removed so that the adhesive strength of the coating is also increased.

Prior to shot peening, a blast cleaning may also be carried out to clean the surface to be coated, wherein in this case the blasting velocity of the blasting media may be set so low that essentially the surface area of the component to be coated is not strengthened, and only cleaning takes place.

All steps of the method according to the invention may be carried out using one and the same device. Therefore, it is possible to use a device for kinetic cold gas spraying for both the blast cleaning as well as the shot peening and the deposition of the coating itself. In this case, only the blasting media must be changed, because inert particles are used for blast cleaning and/or shot peening, while the coating material is used as the blasting media during deposition of the coating.

Brittle and inert materials, such as ceramic substances, sand, glass beads, in particular tungsten carbide particles or the like, may be used for the blast cleaning and/or shot peening. It is also possible to use ice beads.

A correspondingly coated component is characterized in that there is a compaction or strengthened layer beneath the coating applied by kinetic cold gas spraying in which residual compressive stresses have been introduced, which prevent or reduce crack growth or crack propagation. The strengthened layer in this connection is characterized in that this layer is made up predominantly of the base material of the component to be coated, because the compaction does not take place during the deposition of the coating, but already beforehand. In particular, the strengthened layer may be at least partially, in particular however predominantly substantially free of coating material, in particular on the side of the strengthened layer directed towards the inside of the component.

The enclosed drawings depict the following in a purely schematic manner.

DETAILED DESCRIPTION OF THE DRAWINGS

Additional advantages, characteristics and features of the present invention are clarified in the following detailed description of an exemplary embodiment based on the enclosed drawings. However, it is self-evident to a person skilled in the art that the invention is not restricted to this exemplary embodiment.

Figure 1:
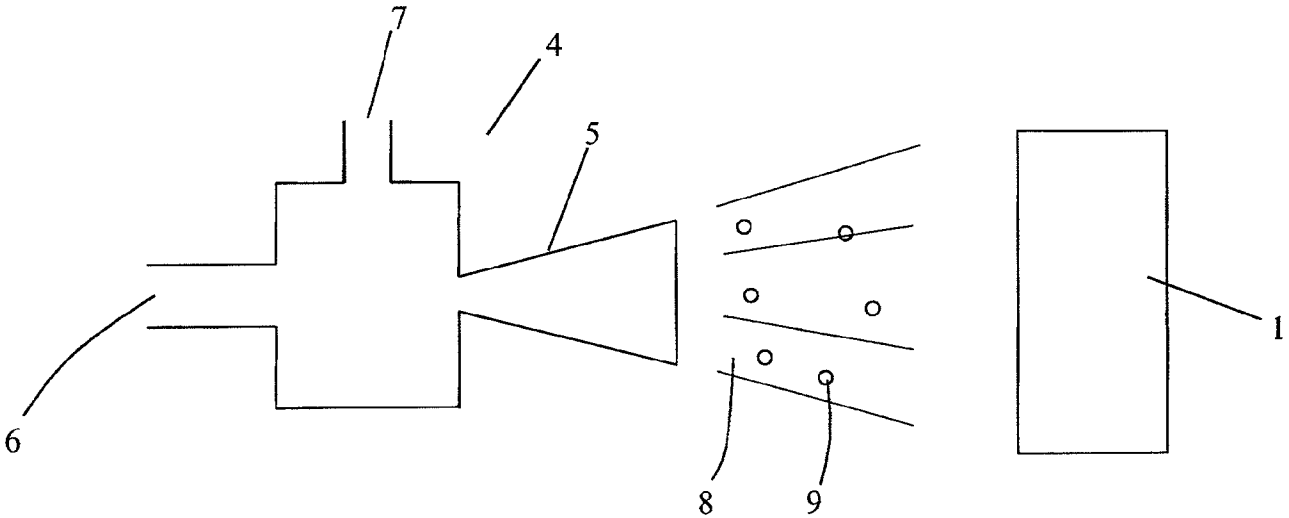
FIG. 1 is a representation of a cold gas spraying device, with which blasting media are accelerated onto the component in order to compact the component surface according to the invention.

FIG. 1 shows a purely schematic representation of a portion of a cold gas spraying device 4, wherein essentially a so-called Laval nozzle 5 is shown through which a blasting media stream 8, made up of a carrier gas and blasting media 9 that are transported therein, is directed onto the component 1 to be coated. The carrier gas is conveyed to the Laval nozzle 5 via the gas supply 6, while the blasting media 9 are guided into the Laval nozzle 5 via a blasting media supply 7.

In the case of the first step of the coating method according to the invention depicted in FIG. 1, adhering dirt and/or an adhering oxide layer are first cleaned off the surface of the component 1 to be coated. For this purpose, inert particles 9, which are preferably also especially brittle, are blasted onto the to-be-coated component surface, wherein the blasting velocity is selected so that the particles 9 do not get embedded in the surface of the to-be-coated component 1, but that only adhering dirt or an existing oxide layer is removed abrasively. Strengthening or compaction of the surface layer of the to-be-coated component 1 does not necessarily take place during this stage of the method. Accordingly, the blasting velocity of the blasting media, i.e., the speed with which the particles 9 are moved onto the component 1, is relatively low in comparison to the following steps of the process.

In particular tungsten carbide particles or generally ceramic particles are possibilities for the blasting media for the cleaning step. In addition, the use of ice particles is also possible. Such particles may be generated, for example, by introducing water into the Laval nozzle 5 via the blasting media supply 7, if a cooling of the introduced water below the freezing point takes place by corresponding adiabatic or quasi-adiabatic expansion.

The same blasting media may also be used preferably during the subsequent step of the coating method, specifically the strengthening step. However, in this case the blasting velocity of the blasting media is selected so that a compaction takes place in the area of the to-be-coated component that is close to the surface. Despite this, the speed of the blasting media is also selected in this case so that the blasting media 9 do not agglomerate or get embedded in the component 1.

Figure 2:
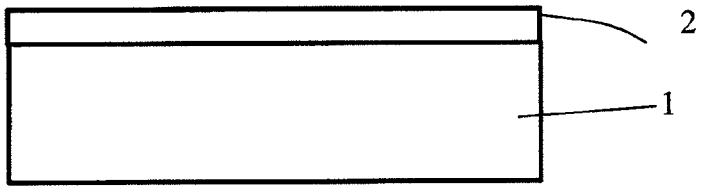
FIG. 2 is a sectional view through a component after the strengthening step.
Figure 3:
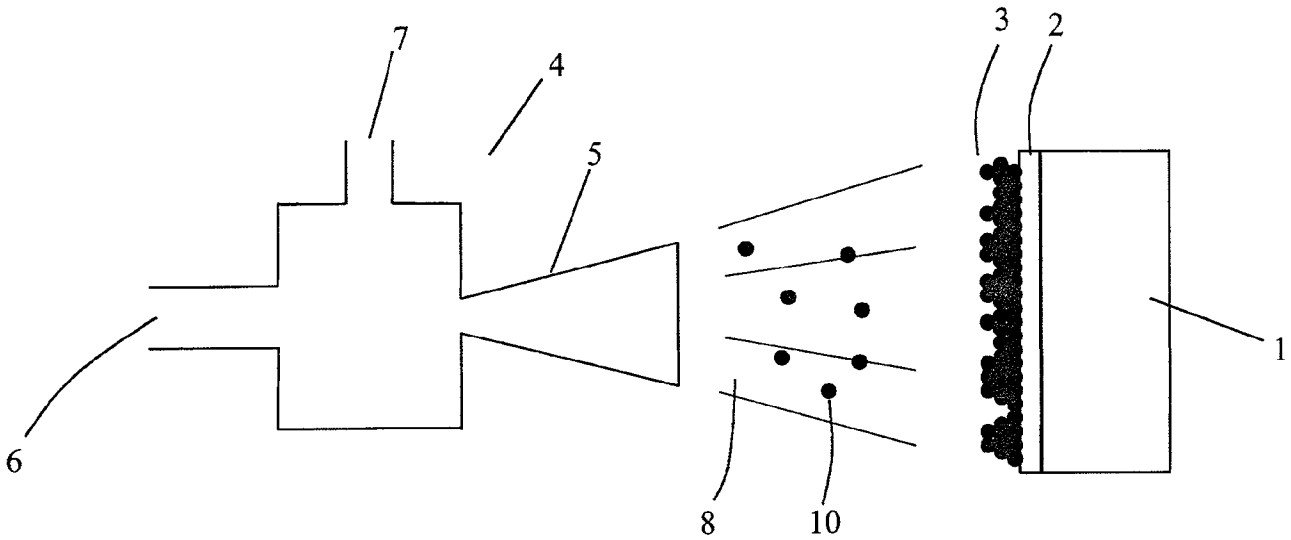
FIG. 3 is a representation of the cold gas spraying device from FIG. 1 while coating the component with a strengthened layer.

With increasing strengthening, the blasting media velocity may be increased further continuously or incrementally in order to create an increased strengthening of the area of the component 1 close to the surface and therefore a strengthened layer 2 (see FIG. 2). In particular, the blasting media velocity may be set to supersonic speed at the end of shot peening in order to achieve an appreciable strengthening, wherein, of course, the surface is also cleaned during shot peening, in particular the oxide layers are removed.

After cleaning and/or strengthening the surface of the component 1 to be coated, coating is carried out using the same cold gas spraying device 4, wherein now, instead of the particles 9 for cleaning and/or strengthening the component surface, coating particles 10 are blasted onto the component 1 with the strengthened layer 2. By using one and the same cold gas spraying device 4 for cleaning, strengthening, and coating the surface, it is possible to transition from the strengthening step to the deposition of the coating continuously so that coating may immediately follow cleaning and/or strengthening. For example, it is possible to switch via the blasting media supply 7 directly from the blasting media, which are used for cleaning and/or strengthening, to coating particles 10.

The coating particles 10 may be more ductile, for example, so that a plastic deformation takes place when they strike the component 1 so that the coating material with the base material of the component 1 or the coating particles 10 deform among each other and flow into each other thereby forming a compact and stable bond. As a result, a coating 3 may be built up on the strengthened layer 2, which was formed in the preceding process step. Based on the fact that the surface of the component 1 to be coated is very clean from the pretreatment and in particular does not have a disadvantageous oxide layer or the like, it is possible to maintain and even improve the adhesive strength of the coating 3 on the component 1 despite the strengthened layer 2. In addition, however, the strengthened layer 2, which is arranged beneath the coating 3 as FIG. 4 shows, makes it possible for the propagation of cracks, which may arise in the coating 3, to be stopped.

Figure 4:
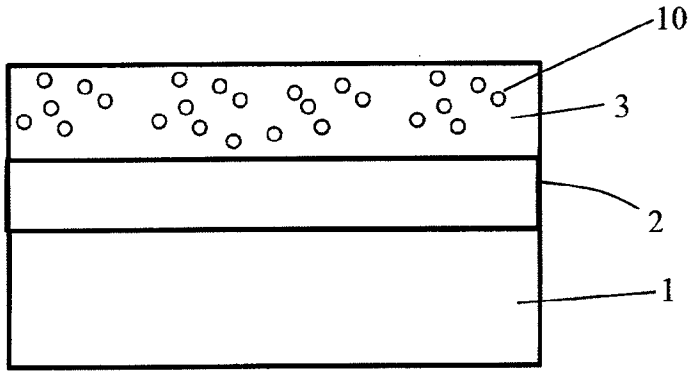
FIG. 4 is a cross-sectional view through a finished coated component.

To better differentiate the strengthened layer 2 and the coating 3, FIG. 4 depicts a few coating particles 10 purely schematically in the coating 3.

Although the present invention was described in detail based on the exemplary embodiment, it is self-evident to a person skilled in the art that this invention is not limited to this embodiment, but that modifications are possible by omitting individual features or by a different combination of features as long as the protective scope of the enclosed claims is not left. In particular, the disclosure of the present invention includes all combinations of all individual features presented.

Further, the foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A method for coating a component, comprising the steps of:

shot peening a surface of the component;

applying a coating to the shot peened surface by kinetic cold gas spraying; and cleaning the surface of the component prior to the step of applying;

wherein the steps of shot peening, cleaning, and applying are performed by a same kinetic cold gas spraying device;

wherein the steps of shot peening and cleaning are performed using first particles and the step of applying the coating is performed using second particles wherein the first particles are different from the second particles;

and further comprising the step of switching directly from the first particles to the second particles via a blasting media supply of the same kinetic cold gas spraying device such that the step of applying the coating transitions continuously from the steps of shot peening and cleaning to immediately follow the steps of shot peening and cleaning.

2. The method according to claim 1, wherein the shot peening is performed in at least two stages and wherein a blasting velocity of the first particles of the shot peening is less during a first stage than during a second stage.

3. The method according to claim 1, wherein the shot peening is performed in multiple stages and wherein each stage has a different blasting velocity of the first particles of the shot peening.

4. The method according to claim 1, wherein the shot peening has a continuously increasing blasting velocity of the first particles of the shot peening during the shot peening.

5. The method according to claim 1, further comprising the step of maintaining a blasting velocity of the first particles of the shot peening such that the first particles do not substantially adhere to the surface.

6. The method according to claim 1, further comprising the step of maintaining a blasting velocity of the first particles of the shot peening below a speed of sound at a beginning of the shot peening.

7. The method according to claim 1, further comprising the step of maintaining a blasting velocity of the first particles of the shot peening above a speed of sound at an end of the shot peening.

8. The method according to claim 1, wherein the first particles are brittle and inert materials.

9. The method according to claim 8, wherein the brittle and inert materials are ceramic substances, sand, glass beads, tungsten carbide particles, or ice beads.

10. The method according to claim 1, wherein the component is a component of a gas turbine or an aircraft engine.

* * * * *